United States Patent [19]

Brown

[11] 4,353,308

[45] Oct. 12, 1982

[54] COG WHEEL RAILWAY

[76] Inventor: Kenneth G. Brown, Wickham Ave., Mattituck, N.Y. 11952

[21] Appl. No.: 167,929

[22] Filed: Jul. 14, 1980

[51] Int. Cl.[3] ..... B61B 13/02; B61B 13/06; B61C 11/04; B61H 7/00

[52] U.S. Cl. ..... 105/29 R; 104/119; 104/120; 105/64 R; 105/145; 188/42; 238/123; 295/4

[58] Field of Search ..... 105/29 R, 64 R, 145; 238/123; 295/4; 104/119, 120; 188/42

[56] References Cited

U.S. PATENT DOCUMENTS

| | | | |
|---|---|---|---|
| 505,845 | 10/1893 | Pruyn | 238/123 |
| 508,824 | 11/1893 | Hazard | 295/4 |
| 732,908 | 7/1903 | Thomson | 105/64 R |
| 896,766 | 8/1908 | Sessions | 238/123 |
| 991,954 | 5/1911 | Charbonneau | 238/123 X |
| 1,140,412 | 5/1915 | Spelling | 105/29 R |
| 1,203,034 | 10/1916 | Morgan | 238/123 |
| 1,537,642 | 5/1925 | Laffey | 105/64 R |
| 2,719,607 | 10/1955 | Scott | 104/120 X |
| 3,459,134 | 8/1969 | Shepheard | 105/29 R X |
| 3,497,089 | 2/1970 | Forster et al. | 105/29 R X |
| 3,540,153 | 11/1970 | Aoki | 105/29 R X |
| 3,589,205 | 6/1971 | Radovick | 295/4 X |
| 3,759,186 | 9/1973 | Sugimoto | 105/29 R X |
| 3,884,153 | 5/1975 | Sugimoto | 238/123 X |
| 4,063,650 | 12/1977 | Homer | 105/29 R X |

FOREIGN PATENT DOCUMENTS

| | | | |
|---|---|---|---|
| 13098 | of 1915 | United Kingdom | 105/291 R |

*Primary Examiner*—Joseph F. Peters, Jr.
*Assistant Examiner*—Howard Beltran
*Attorney, Agent, or Firm*—James P. Malone

[57] ABSTRACT

Cog wheel vehicle system. A single track consists of a square beam having a pair of flanges. There is a row of holes in each flange. A vehicle rides on the track and has a cog wheel engaging the holes in the flange. A directional hydraulic motor is connected to drive the cog wheel. A hydraulic pump is connected to drive the motor. A gasoline engine is pivotally mounted on the vehicle and is connected to drive the pump.

10 Claims, 10 Drawing Figures

COG WHEEL RAILWAY

TECHNICAL FIELD

This invention relates to cog wheel vehicles and more particularly to such vehicles using a single track consisting of a square beam.

BACKGROUND ART

A prior Cog Wheel System, U.S. Pat. No. 505,845, is shown where the rail has alternating holes on each side which are engaged by a wheel having alternating cogs on each side.

THE PRESENT INVENTION

The present invention is designed to travel up steep hills, cliffs or bluffs.

There are many instances where eroding shore lines have created narrow beaches which are backed up by steep cliffs or bluffs which may be one hundred feet or more high. This makes the beach inaccessible unless expensive stairways are built on the face of the cliff or bluff. It is difficult or impossible to maintain these stairways, especially during storms since they are frequently washed out by the surf.

The present invention solves these problems by providing a single track for a cog wheel vehicle comprising a single square beam with flanges. This beam is practically indestructable and can be installed and moved relatively easy. The vehicle when necessary can be protected from the storms by keeping it on higher ground. The vehicle of the present invention can be easily driven off the end of the track on the high ground for safe storage, for instance, in a shelter. The cog wheel system of the present invention can also be used for crossing ravines.

OBJECTS OF THE INVENTION

Accordingly, a principal object of the invention is to provide new and improved cog wheel vehicle means.

Another object of the invention is to provide new and improved cog wheel vehicle means for climbing cliffs or bluffs.

Another object of the invention is to provide new and improved cog wheel vehicle means for climbing cliffs or bluffs using a single track which is easily installed, moved and maintained.

Another object of the invention is to provide new and improved cog wheel vehicle means for climbing cliffs or bluffs using a single track which is easily installed, moved and maintained wherein the track comprises a single square beam with flanges having holes for the cog wheels.

Another object of the invention is to provide new and improved cog wheel vehicle means having automatic emergency braking means, and locking means.

Another object of the invention is to provide new and improved cog wheel vehicle means comprising, a track consisting of a square beam and a pair of flanges connected to the beam, a row of holes in each flange, a vehicle adapted to ride on said track, at least one cog wheel on the vehicle, the cog wheel engaging the holes in the flange and connected to a gasoline driven hydraulic drive system.

These and other objects of the invention will be apparent from the following specification and drawings:

BEST MODE OF THE INVENTION

Figure 3:
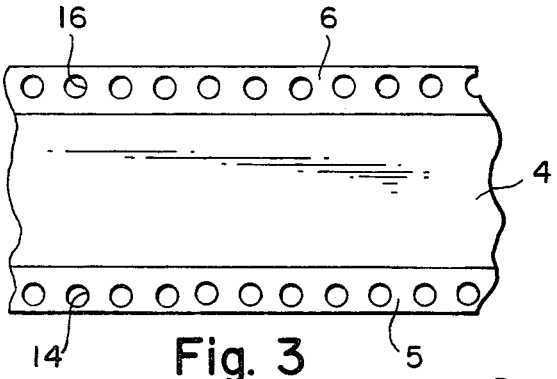
FIG. 3 is a top view of the beam with flanges having holes for the cogs.
Figure 1:
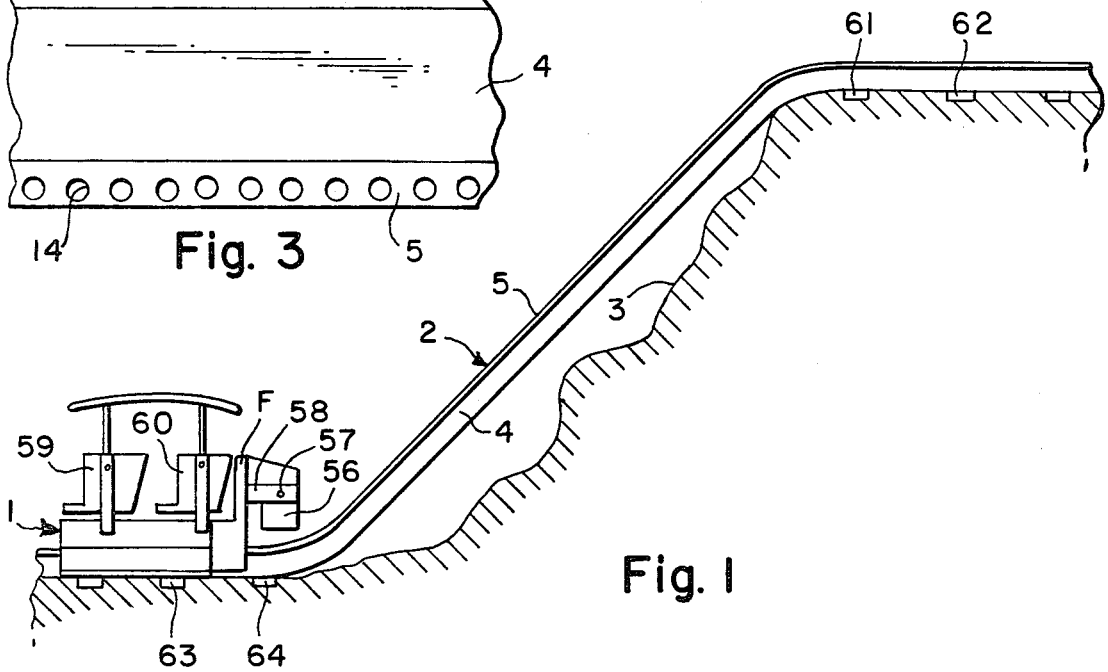
FIG. 1 is a side view of an embodiment of the invention illustrating the use thereof.
Figure 2:
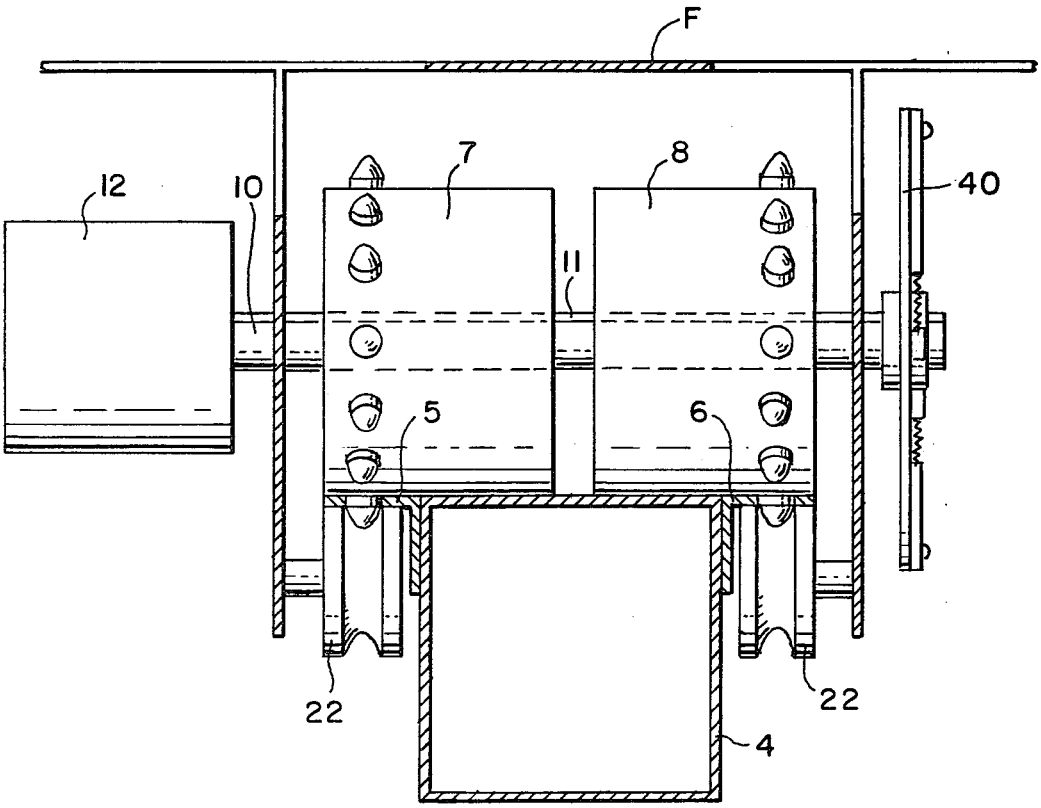
FIG. 2 is a detail view partly in section showing the cog wheel drive.

Referring to the Figures, the invention comprises a cog wheel vehicle 1, which is adapted to ride on the track 2, up a relatively steep cliff or bluff 3. The vehicle rides on a single track comprising a square beam 4 having flanges 5 and 6. Two pairs of cog wheels 7, 7', 8, 8' are mounted on the axles 10, 10' and they are keyed to the axles by means of the key 11 so that the wheels 7 and 8 can slide axially along the axle in order to accommodate any non-linearity of the rows of holes in the flanges. The cog wheels are driven by the hydraulic motors 12, 12' which is a low speed high torque hydraulic motor. On one end of the axle 10' is mounted a disc type brake 13.

The beam 4 may be anchored at top and bottom by railroad ties 61, 62, 63 and 64, or equivalent means.

FIG. 3 shows a top view of the beam 4 with flanges 5 and 6, each flange contains a row of holes 14, 16, etc. The square beam 4 is a commercially available steel beam which may be approximately 3/16" thick. The flanges 5 and 6 are welded to the beam. The holes 14, 16, etc., are put in the flanges before the flanges are welded to the beam. It is difficult to control the linearity of the holes during the manufacturing process so that the cog wheels 7 and 8 have been split into separate halves which can slide axially in order to accommodate variations in the spacings of the holes in the direction transverse to the beam.

Gas engine 56 is pivotally mounted on pin 57 in bracket 58, mounted on frame F. Seats 59 and 60, are pivotally mounted on frame F like Ferris Wheel seats, and have similar guards. The seats will accommodate three people in each seat.

Figure 4:
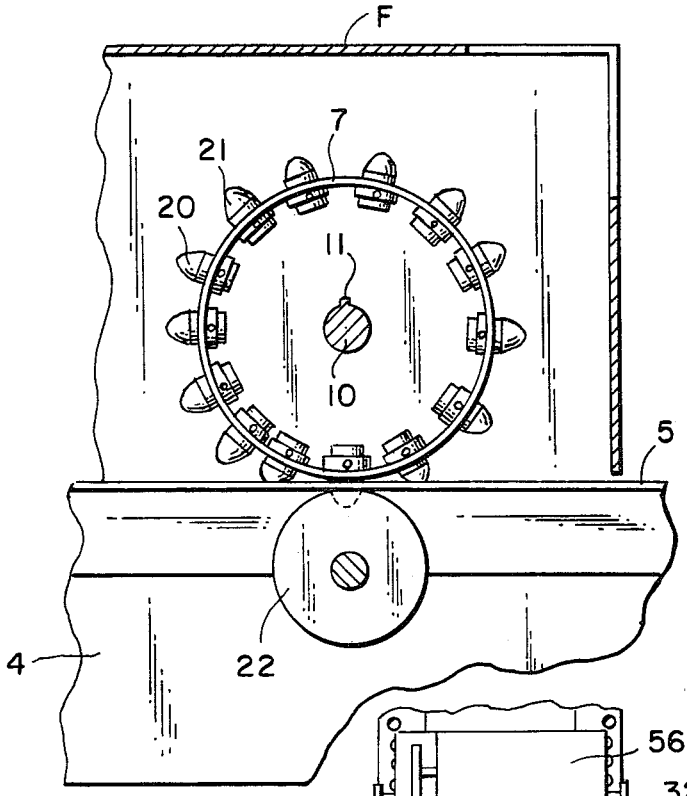
FIG. 4 is a side detail view showing the cog wheels on the track.

FIG. 4 shows the side view of cog wheel 7 having a plurality of pins or cogs 20, 21, etc. One of the pins or cogs is shown in FIG. 5.

The cog engages the holes in the flange 5 on the beam 4 and the frame of the vehicle is locked on to the flanges by means of the wheels 22 which ride along the underside of the flanges.

Figure 5:
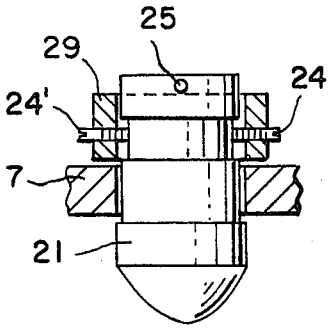
FIG. 5 is a detail view of cog or pin.

FIG. 5 shows a detail view of the pins. The pins are made of heat treated and hardened steel and they are held onto the wheels by means of two set screws 24, 24' and one roll pin 25, in collar 29 attached to wheel 7.

Figure 6:
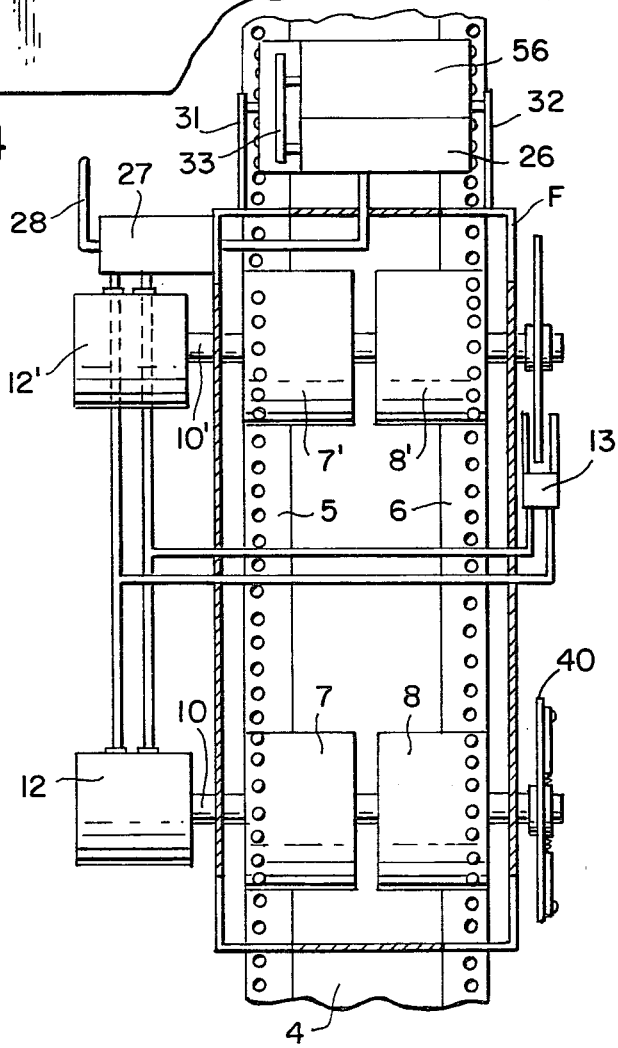
FIG. 6 is a detail top view showing the track and cog wheel drive.

FIG. 6 shows a top view illustrating the drive system. The cog wheels 7 and 8 and 7' and 8' ride on the flanges 5 and 6 so the cog engages the holes in the flanges. As previously mentioned, the cog wheels are split and can move axially in order to accommodate any manufacturing variations in the linearity of the holes in the flanges. The cog wheels are mounted on the axles 10 and 10' and driven by the hydraulic motors 12 and 12'. The axles have keys and the wheels have keyways to permit the sliding movements of the split wheels.

The hydraulic motors are driven by a hydraulic pump 26 through directional valve 27, which is controlled by the lever 28, which extends up to the generator's position. The pump 26 is driven by the gasoline engine 56, which is pivotally mounted on the frame members 31, 32, which extend from the end of the vehicle frame F. The purpose of this mounting is that the gasoline engine still remains level at all times regardless of the climbing angle. This is necessary so that the gas feed and lubrication of the motor will not be disturbed by tilting. The output of the gasoline engine is connected to the pump by means of a belt drive 33. The gasoline engine is started from a storage battery similar to that in conventional automobiles. The speed of the gasoline engine is pre-set by the throttle and it is normally not controlled by the operator so that the vehicle only has one speed which is very slow, for instance, one mile per hour, which is practical since the vehicle only travels a very short distance. Particular installations may use one or more hydraulic motors.

The conventional directional valve 27 has Forward, Rear and Neutral positions. The gasoline engine 56 may be a 16 H.P. engine such as used in small garden tractors, with conventional controls.

The disc brake 13 is conventional. It is normally spring locked and is released when hydraulic pressure is applied to the motors. It may be a safety disc brake as manufactured by Toolamatic Inc.

Figure 7:
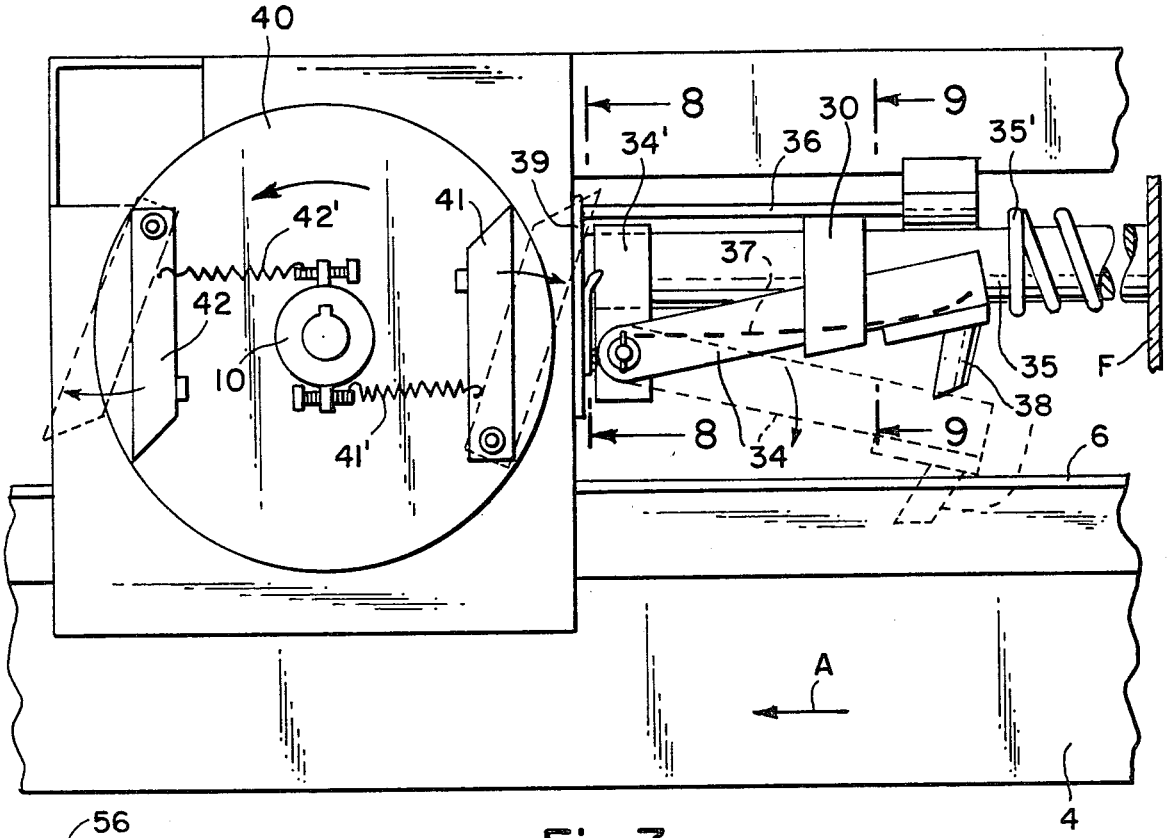
FIG. 7 is a detail view showing the emergency stop and lock mechanism.
Figure 8:
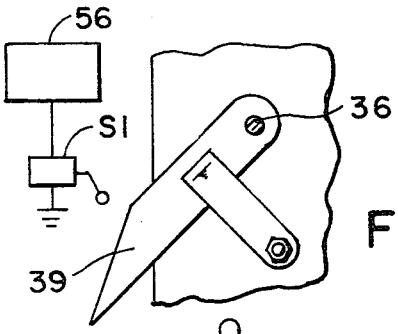
FIG. 8 is a sectional view taken along the lines 8—8 of FIG. 7.
Figure 9:
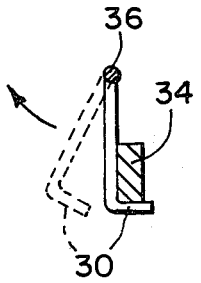
FIG. 9 is a detail sectional view taken along the lines 9—9 of FIG. 7.

FIGS. 7, 8 and 9 show the emergency stop and lock mechanism which is operated by a centrifugal tripping device.

The automatic stop and lock mechanism shown in FIG. 7 comprises a lever 34, which is mounted on the shock absorber shaft 35. The lever 34 is normally held by the latch 30, FIGS. 7 and 9 which is pivotally mounted on the rod 36. When the latch is released, a leaf spring 37 pushes down the lever so that the locking pin 38 engages a hole in the flange 6, as shown by the dotted lines.

Lever 34 is pivotally mounted on sleeve 34' which is slidably mounted on shock absorber rod 35. The shock absorber rod 35 is fixedly mounted in the frame F. When the downhill speed in direction of arrow A is exceeded, the latch trip 40, 41, 42 releases the lever 34 which drops and pin 38 engages one of the holes in the flange 6. The sleeve 34' then compresses the spring 35' which minimizes the shock of stopping.

The latch trip mechanism comprises a disc 40, which is mounted on a drive axle 10. The disc 40 has two pivotally mounted pawls 41, 42 which are held inside the disc area by means of the spring 41', 42'. The springs are adjusted so that if the disc exceeds a pre-determined speed, for instance, one mile per hour, the pawls fill fly out by centrifugal force and trip the arm 39, which causes the latch rod 36 to rotate the latch 30 to release the lever 34. Also, arm 39 closes switch S1 which grounds out and stops the gas engine. Therefore, oil pressure drops and the disc brakes 13 lock.

Figure 10:
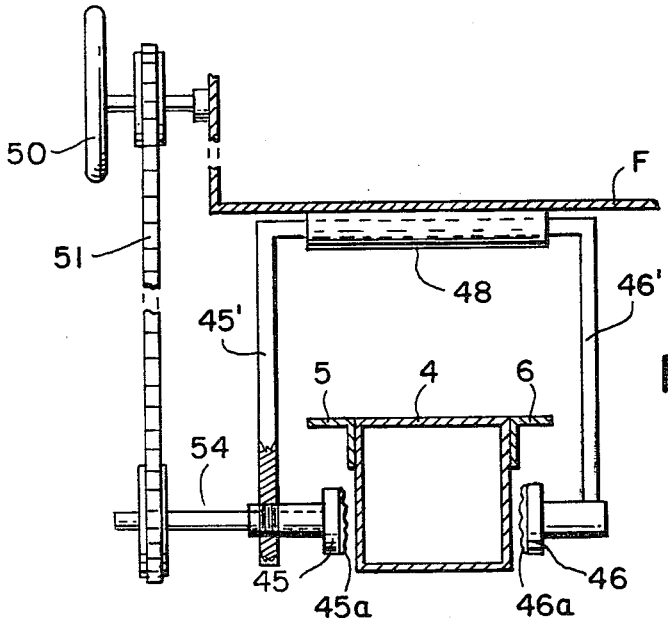
FIG. 10 is a sectional view showing a hand operated brake mechanism.

FIG. 10 shows a sectional view of a hand-brake mechanism which is normally used to lock the vehicle on the beam 4, when it is not in use but which could also be used in an emergency. This hand-brake system comprises a pair of brake shoes, 45, 46, which are mounted on a C clamp frame 45', 46'. The C clamp frame is movable in the tubular member 48 mounted on the frame F. The brake is operated by turning the hand wheel 50 which is connected by chain 51, to the threaded shaft 54 which is threadedly connected to the hub of C clamp 45', 46'. The operation of C clamps is well known and conventional. Therefore, by turning the hand wheel 50, the brake shoes 45 and 46 will be tightened against the beam 4. The brake shoes have brake linings **45*a*, 45*b*, preferably made of asbestos or other long wearing friction material. The brakes 45, 46, are connected to tie rods, not shown, which are anchored to the vehicle frame to prevent rotation of the "C" frame in support 48**.

The invention is not limited to relatively short distances but could be used for ski lifts of relatively long lengths.

Also, additional cars could be hooked onto the first car and be towed. The engine power may be connected with other types of transmissions instead of hydraulic power.

The beam may be suspended for relatively long lengths and used to bridge ravines. On shore line cliffs, the beam may support bulkheads designed to minimize or stop erosions by waves and storms.

It is claimed:

1. Cog wheel vehicle means comprising:

a track consisting of a square beam forming a tread and a pair of exterior flanges connected to the beam extending the tread laterally, a row of holes in each flange, a vehicle adapted to ride on said track, an axle, a pair of cogs on a wheel on said axle, the cogs engaging the holes in the flange, means connected to said axle to drive the cog wheel, an engine pivotally mounted on the vehicle, the engine being connected to the axle to drive the cog wheel driving means.

2. Apparatus as in claim 1, wherein a speed actuated emergency stopping means engages the holes in the flange.

3. Apparatus as in claim 1 wherein the cog wheel riding on one flange is separate from the cog wheel riding on the other flange so that the wheels will accommodate themselves to variations of the hole spacing, the wheels being movable laterally on their drive axle.

4. Apparatus as in claim 1, where said drive means is a directional hydraulic motor connected to drive the cog wheel.

5. Apparatus as in claim 4, where an hydraulic pump is connected to drive the motor.

6. Apparatus as in claim 5 where a directional valve is connected between the pump and the hydraulic motor, and the directional valve having forward, reverse and neutral positions.

7. Apparatus as in claim 5, wherein a gasoline engine is pivotally mounted on the vehicle, the engine being connected to drive the pump.

8. Apparatus as in claim 5, where disc brakes are connected to the hydraulic pump so that the disc brakes are normally held open when pressure is applied to the hydraulic motors.

9. Cog wheel vehicle means comprising:

a track consisting of a square beam and a pair of flanges connected to the beam, a row of holes in each flange, a vehicle adapted to ride on said track, at least one cog wheel on the vehicle, the cog wheel engaging the holes in the flange, a directional hydraulic motor connected to drive the cog wheel, a hydraulic pump connected to drive the motor, an engine pivotally mounted on the vehicle, the engine being connected to drive the pump, disc brakes connected to the hydraulic pump so that the disc brakes are normally held open when pressure is applied to the hydraulic motors, speed actuated emergency stopping means, the emergency stopping means comprising a shock absorber mounted on the vehicle, a lever connected to the shock absorber, a pin mounted on the lever, the pin being adapted to engage the holes in the flanges, a latch mounted on the vehicle and connected to hold the lever, a centrifugally operated member mounted on a wheel shaft of the vehicle connected to trip the latch at a pre-determined speed.

10. Cog wheel vehicle means comprising:

a track consisting of a square beam and a pair of flanges connected to the beam, a row of holes in each flange, a vehicle adapted to ride on said track, at least one cog wheel on the vehicle, the cog wheel engaging the holes in the flange, hand operated brake means on the vehicle comprising:

a C clamp frame slidably mounted on the vehicle for transverse motion, the jaws of the C clamp frame extending into gripping proximity to the sides of the square beam, a first brake shoe fixed to the C clamp frame, a second brake shoe mounted on the C clamp frame, a second brake shoe mounted on a threaded shaft, the said shaft being threadedly mounted in the hub of the C clamp on the frame, and a handwheel connected to rotate the threaded shaft to tighten the brake shoes against the sides of the square beam.

* * * * *